US010724816B2

(12) United States Patent
Alicea, Jr.

(10) Patent No.: US 10,724,816 B2
(45) Date of Patent: Jul. 28, 2020

(54) ELECTRONIC OPERATING MECHANISM FOR A FIREARM

(71) Applicant: Benjamin Alicea, Jr., Oldsmar, FL (US)

(72) Inventor: Benjamin Alicea, Jr., Oldsmar, FL (US)

( * ) Notice: Subject to any disclaimer, the term of this patent is extended or adjusted under 35 U.S.C. 154(b) by 0 days.

(21) Appl. No.: 16/411,825

(22) Filed: May 14, 2019

(65) Prior Publication Data

US 2020/0025488 A1 Jan. 23, 2020

Related U.S. Application Data

(60) Provisional application No. 62/671,149, filed on May 14, 2018.

(51) Int. Cl.
*F41A 19/59* (2006.01)
*F41A 19/69* (2006.01)
*F41A 17/06* (2006.01)

(52) U.S. Cl.
CPC ..... *F41A 19/59* (2013.01); *F41A 19/69* (2013.01); *F41A 17/06* (2013.01)

(58) Field of Classification Search
CPC ..... F41A 19/59
USPC ..... 42/84; 89/135
See application file for complete search history.

(56) References Cited

U.S. PATENT DOCUMENTS 1,331,018 A 2/1920 Luthy
2,780,882 A 2/1957 Temple
3,045,555 A 7/1962 Stoner
3,301,133 A 1/1967 Sturtevant
3,442,173 A 5/1969 Muller
4,727,670 A 3/1988 Krouse
4,793,085 A 12/1988 Surawski et al.
5,251,533 A 10/1993 Layton
5,465,518 A 11/1995 Blaser
5,713,150 A 2/1998 Ealovega
5,727,538 A 3/1998 Ellis
6,412,207 B1 7/2002 Crye et al.
6,442,880 B1 9/2002 Allan
6,615,527 B1 9/2003 Martin
6,626,165 B1 9/2003 Styles et al.
6,976,416 B2 12/2005 Ealovega
7,765,999 B1 8/2010 Stephens et al.
7,819,051 B1 10/2010 Beckmann et al.
8,336,438 B2 12/2012 Compton et al.
8,667,881 B1 3/2014 Hawbaker
8,807,007 B2 8/2014 Aicea
9,151,559 B2 10/2015 Alicea, Jr.
9,395,130 B2 7/2016 Jacobson
9,429,379 B2 8/2016 Fellows
9,551,546 B2 1/2017 Aiicea, Jr.
9,658,017 B2 5/2017 Alicea, Jr.
10,030,928 B2 7/2018 Alicea, Jr.
(Continued)

*Primary Examiner* — Reginald S Tillman, Jr.
(74) *Attorney, Agent, or Firm* — Taft Stettinius & Hollister LLP

(57) ABSTRACT

There is disclosed herein systems, methods and apparatus relating to a firearm with an electronically operable firing system to fire projectiles from the firearm. The electronic firing system includes an electronic actuator with a switch for electronically firing the firearm and a trigger lever connected to the trigger. The trigger lever is reciprocally moveable along the fastening member in response to a pull of the trigger to displace the trigger lever and actuate the switch to fire the firearm.

20 Claims, 6 Drawing Sheets

(56) References Cited

U.S. PATENT DOCUMENTS

| | | | |
|---|---|---|---|
| 10,107,580 | B2 | 10/2018 | Fellows et al. |
| 10,113,823 | B2 | 10/2018 | Alicea, Jr. |
| 10,254,059 | B1 | 4/2019 | Fellows et al. |
| 10,295,290 | B2 | 5/2019 | Fellows et al. |
| 10,393,461 | B2 | 8/2019 | Fellows et al. |
| 10,480,881 | B2 | 11/2019 | Fellows et al. |
| 10,480,882 | B2 | 11/2019 | Fellows et al. |
| 2006/0169268 | A1 | 8/2006 | Tippmann |
| 2009/0255160 | A1 | 10/2009 | Summers |
| 2010/0186277 | A1 | 7/2010 | Beckmann |
| 2011/0061280 | A1 | 3/2011 | Emde |
| 2011/0232618 | A1 | 9/2011 | Gabrel |
| 2013/0019510 | A1 | 1/2013 | Kemmerer |
| 2013/0019512 | A1 | 1/2013 | Kemmerer |
| 2013/0118050 | A1 | 5/2013 | Alicea |
| 2013/0125441 | A1 | 5/2013 | Westwood |
| 2013/0167423 | A1 | 7/2013 | Lupher |
| 2013/0180147 | A1 | 7/2013 | Lupher |
| 2015/0198402 | A1 | 7/2015 | Brace |
| 2016/0018176 | A1 | 1/2016 | Fellows et al. |
| 2016/0084601 | A1 | 3/2016 | Alicea, Jr. |
| 2017/0122686 | A1 | 5/2017 | Fellows et al. |
| 2018/0321007 | A1 | 11/2018 | Alicea, Jr. |

ELECTRONIC OPERATING MECHANISM FOR A FIREARM

CROSS-REFERENCE TO RELATED APPLICATION

The present application claims the benefit of the filing date of U.S. Provisional App. Ser. No. 62/671,149 filed on May 14, 2018, which is incorporated herein by reference. The present application is related to U.S. Pat. No. 9,551,546 issued on Jan. 24, 2017, and U.S. Pat. No. 9,658,017 issued on May 23, 2017, each of which is incorporated herein by reference in its entirety.

BACKGROUND

Firearms typically rely on mechanical systems to control the firing of projectiles from the firearm. When firearms employ multiple firing modes, the complexity of the mechanical systems increase, and in some cases certain firing modes are not possible or feasible due to the mechanical complexity involved. In addition to increasing the number of components involved in the firing, the potential for failure increases due to wear and malfunction of the components.

Firearms with electronic systems present an opportunity to reduce the mechanical complexity of firearms, particularly those with multiple firing modes. However, despite the shortcomings of mechanical systems, electronically operated firing systems for firearms have not been widely adopted due to perceived shortcomings with electronically operated firing systems. Therefore, further improvements in this area are needed.

SUMMARY

There is disclosed herein systems, methods and apparatus relating to a firearm with an electronically operable firing system to fire projectiles from the firearm. In one embodiment, the systems, methods and apparatus include firing mechanisms for mechanically and/or electronically firing a firearm.

This summary is provided to introduce a selection of concepts that are further described below in the illustrative embodiments. This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings.

DESCRIPTION THE ILLUSTRATED EMBODIMENTS

Figure 1:
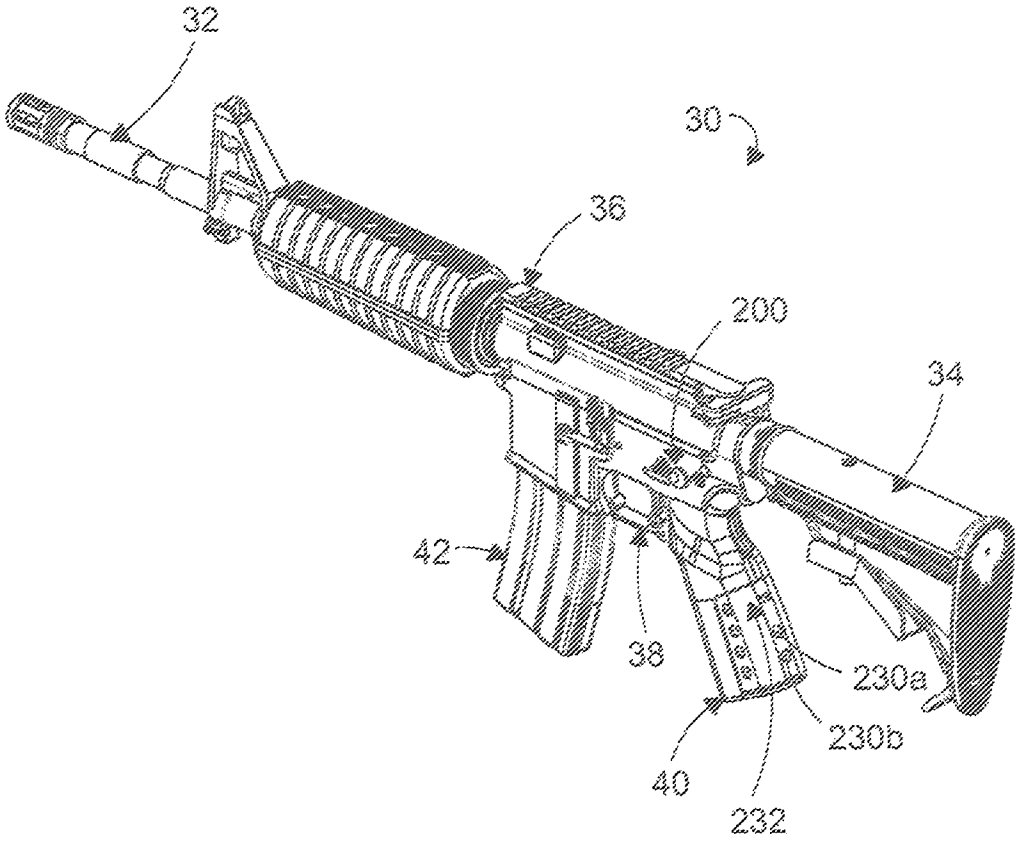
FIG. 1 is a perspective view of one embodiment of a firearm.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

Referring to FIG. 1, there is shown a selection fire weapon 30 that includes a barrel 32, a butt stock 34, an upper receiver 36, and a lower receiver 38. Selective fire firearm 30 also includes a grip assembly 40 and a magazine 42 secured to lower receiver 38. It should be understood that not all details of selective fire firearm 30 are shown and/or described, it being understood that the present disclosure has application to any firearm that is a selective fire type weapon, including an M-16, M-4, AK-47 type firearms, sub-machine guns, and HK style firearms.

Figure 2:
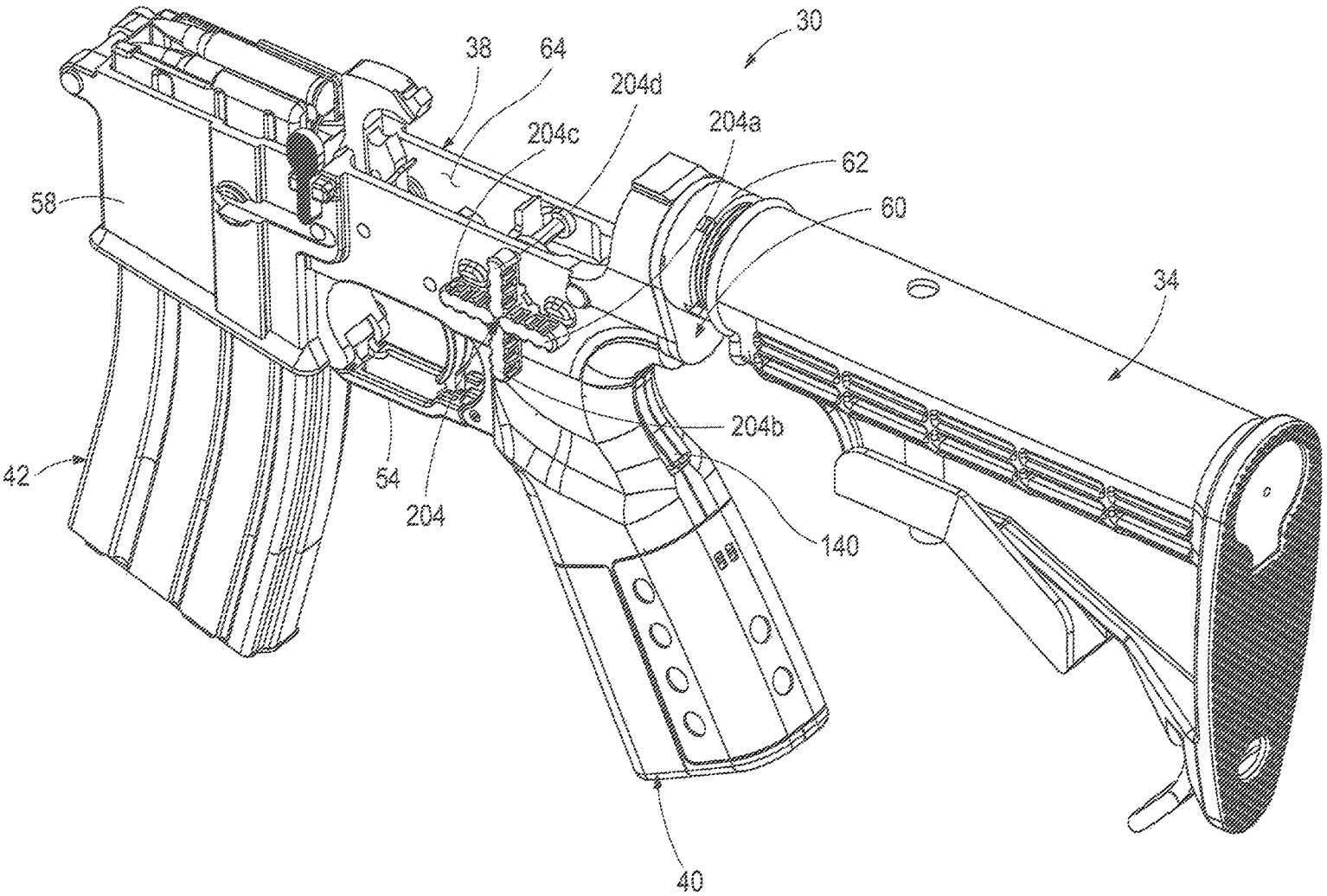
FIG. 2 is a perspective view of the lower receiver, grip assembly and buttstock of the firearm of FIG. 1.
Figure 3:
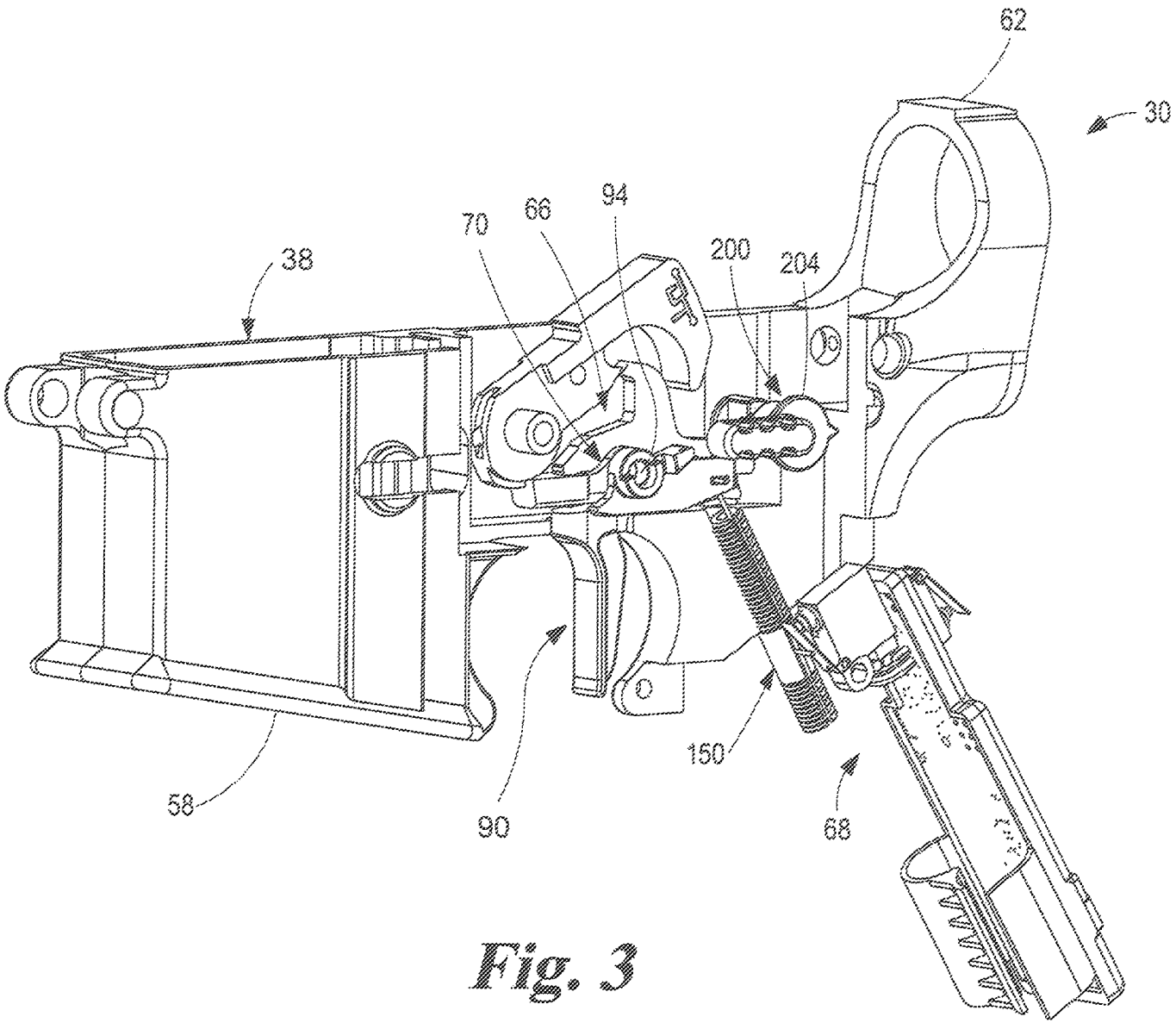
FIG. 3 is a side perspective transparent view of the lower receiver and an internal part of the grip assembly of FIG. 1 showing a firing system that is actuated by the trigger.

Referring further to FIGS. 2-3, selective fire firearm 30 further includes a mechanical firing system 66 generally associated with lower receiver 38 and an electronic firing system 68 generally associated with grip assembly 40. As discussed further below, electronic firing system 68 is structured to selectively interface with and operate mechanical firing system 66 in an electronic firing mode of selective fire firearm 30. Selective fire firearm 30 includes a selector mechanism 200 that includes a mode selector 204 that is movable between four positions that each define and configure selective fire firearm 30 in a corresponding operating mode.

As shown in FIG. 2, the predefined positions for mode selector 204 include: a safety mode position 204*a*, a semi-automatic firing mode position 204*b*, an automatic firing mode position 204*c*, and an electronic firing mode position 204*d*. As used herein, an automatic firing mode includes a fully automatic firing mode in which a single pull continuously fires rounds until the trigger is released or the ammunition is depleted, and a burst firing mode in which more than one round but less than all the available rounds are fired in a single trigger pull, such as a three shot burst. Other embodiments contemplate more or fewer modes for selection, and different types of modes and mode selectors. For example, a fully automatic mode may be omitted.

Figure 6:
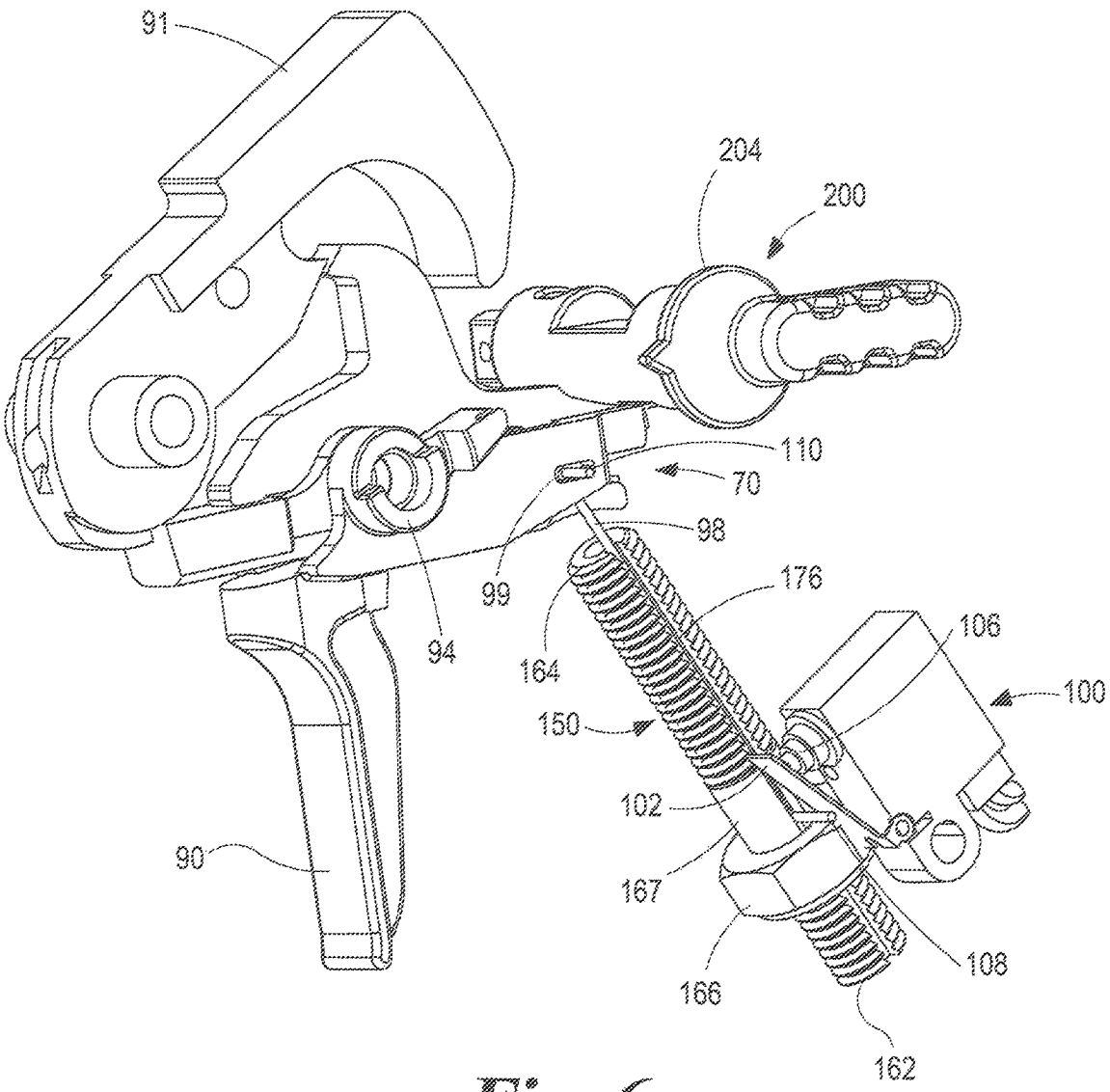
FIG. 6 is a perspective view showing a connection arrangement between the trigger lever and trigger of the firing system.

Lower receiver 38 includes a magazine holder 58 for receiving magazine 42 and a housing 60 with a buffer tube or stock assembly attachment member 62 at a rearward end thereof. Housing 60 defines a compartment 64 for housing at least a portion of mechanical firing system 66, such as a sear assembly 70 and a trigger 90. Other embodiments contemplate a hammer and/or auto sear as part of a mechanical firing assembly 66. Trigger 92 is coupled to sear assembly 70 with a pin arrangement 94, which also couples sear assembly 70 to lower receiver 38. A hammer 91 (FIG. 6) is movable between a cocked position to a released position by pulling of trigger 90. Trigger 90 can be housed in a trigger guard 54 of lower receiver 38. Trigger guard 54 is shown as removable, but can also be fixed and/or formed as one-piece with lower receiver 38.

As shown in FIG. 2, mode selector 204 is provided as part of selector mechanism 200 and is rotatably mounted to lower receiver 38. As mentioned above, mode selector 204 is movable between the safety mode position 204*a*, the automatic firing mode position 204*c*, and the electronic firing mode position 204*d*. In the safety mode position 204*a*, sear assembly 70 (FIG. 3) is blocked by a portion of selector mechanism 200 to prevent any mechanical firing mode of operation and the mode selection switch is off to prevent an electronic firing mode of operation. In the semi-automatic firing mode position 204*b*, the sear assembly 70 allows a semi-automatic mode of operation. In the automatic firing mode position 204*c*, the sear assembly 70 provides an automatic mode of firing operation. In the electronic firing mode position 204*d*, the sear assembly 70 is not blocked by the mode selector to allow the electronically actuated actuator 130 to pivot the sear assembly 70 to release the hammer.

Figure 4:
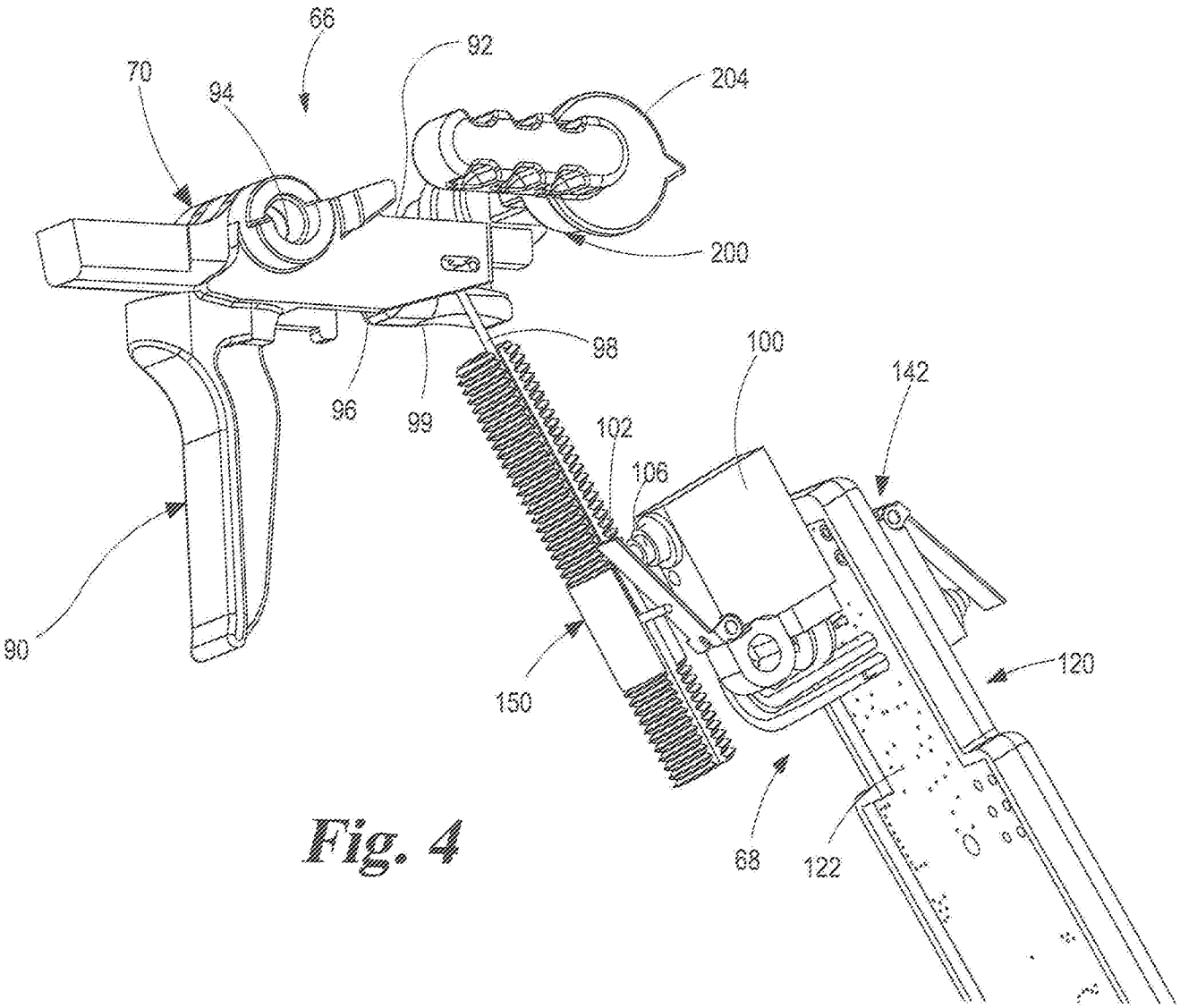
FIG. 4 is a perspective view showing some of the electronic and mechanical components of the firing system of FIG. 3.

As further shown in FIG. 4, trigger 90 includes a trigger arm 96 extending rearwardly from pin arrangement 94 at an upper end of trigger 90. Trigger arm 96 is connected at its outer rearward end 92 to a trigger lever 98. Trigger lever 98 extends into grip assembly 40 from trigger arm 96 toward a first switch 100, and trigger lever 98 is supported on a switch actuator 102 for sliding movement therealong in response to pulling and releasing of trigger 90, which pivots trigger arm 96 to longitudinally displace trigger lever 98 along switch actuator 102. In one embodiment, switch actuator 102 is a flat metal tab or plate that is pivotal about a hinge to depress and release button 106. Switch actuator 102 is in engagement with button 106 of first switch 100 so that button 106 is selectively depressed and released to actuate first switch 100 by switch actuator 102 as trigger lever 98 moves along switch actuator 102.

Figure 5B:
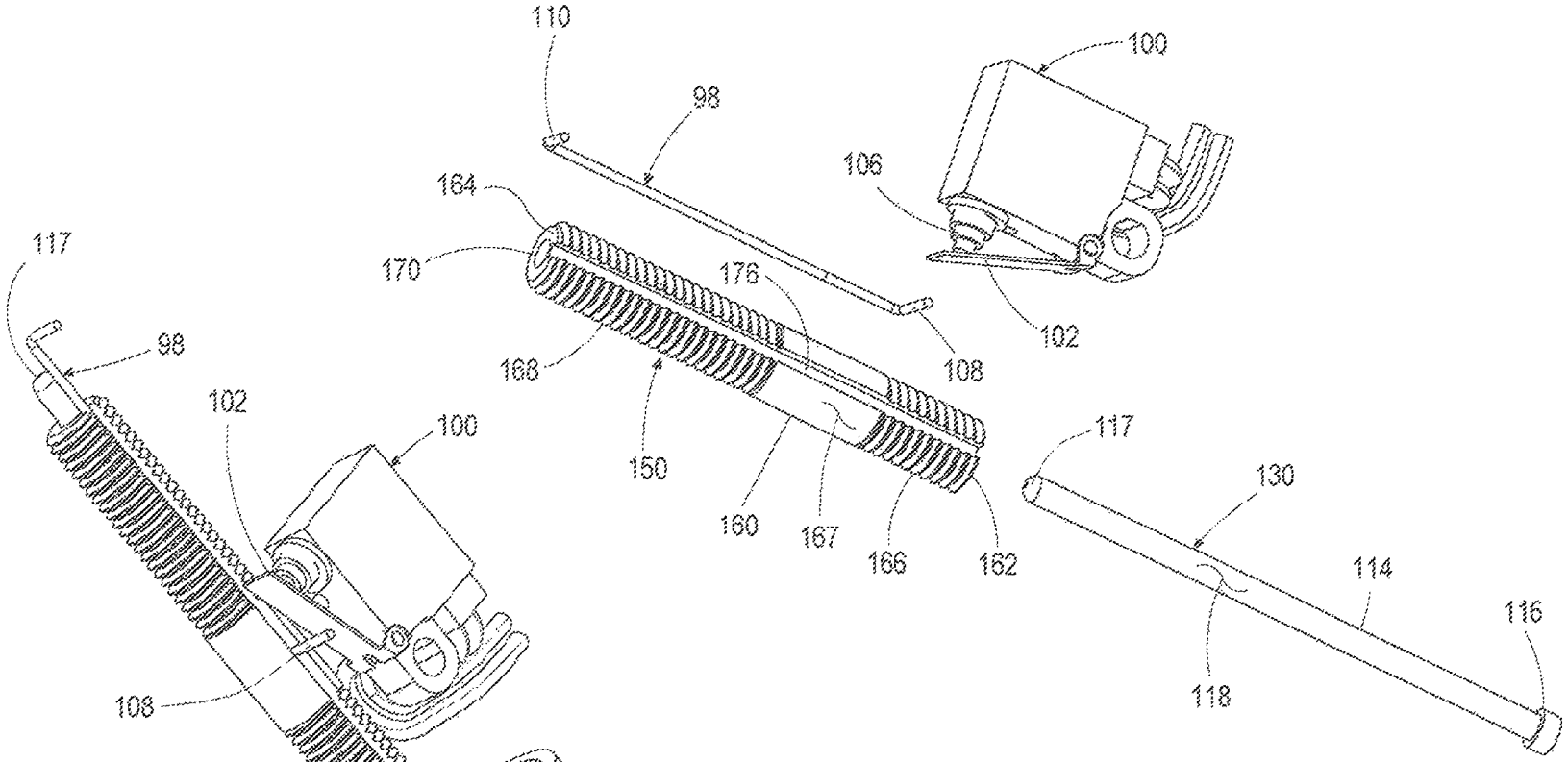
FIGS. 5A and 5B illustrate assembled and exploded perspective views, respectively, of the various components of the firing system of FIG. 3.
Figure 5A:
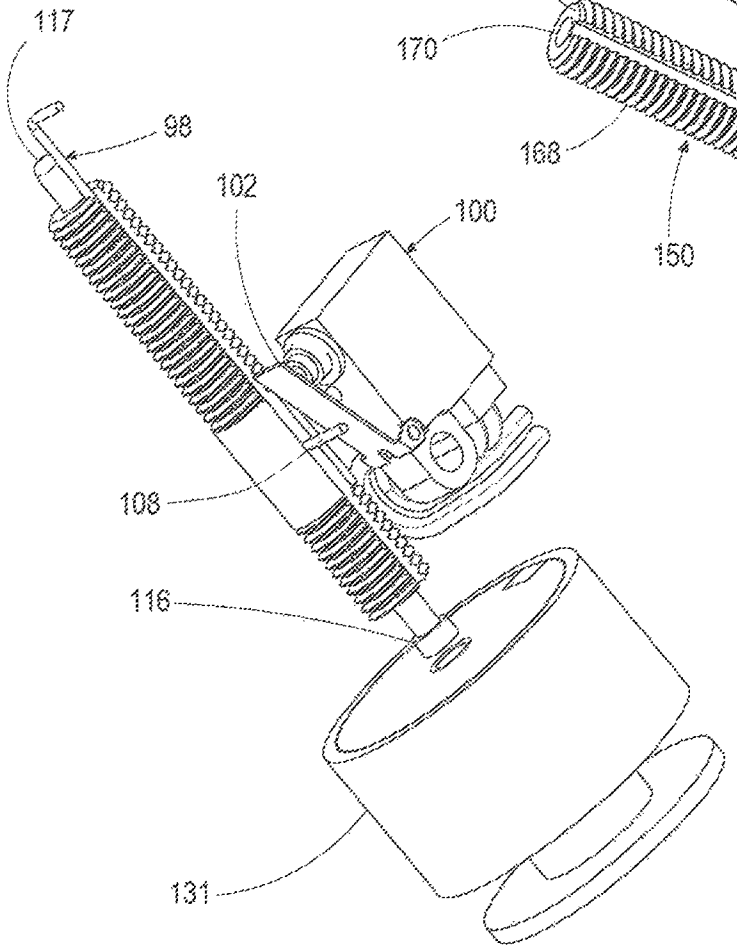

As further shown in FIGS. 5A and 5B, trigger lever 98 includes an L-shaped engagement end portion 108 at a first end thereof that rides along switch actuator 102 to press and release button 106. Other shapes are also contemplated, such as U-shaped, V-shaped, or any other shape that allows contact with actuator 103. As further shown in FIG. 6, trigger lever 98 includes an L-shaped or other suitable shaped engagement arm 110 at a second end thereof that is received in a receptacle 99, such as a bore as shown, in trigger arm 96. Embodiments contemplate that receptacle 99 could be an elongated slot that is enclosed as shown, or open at one end to accommodate insertion of engagement arm 110 into receptacle 99. The pivoting movement of trigger 90 lifts trigger arm 96, which displaces trigger lever 98 along switch actuator 102.

Switch 100 is electrically connected to an electronic circuit 120 which electronically controls actuator 130 to fire selective fire firearm 30 in an electronic firing mode. Electronic circuit 120 includes a programmable printed circuit board 122 connected to actuator 130 and a power source, such as batteries, to power printed circuit board 122. A solenoid 131 or other suitable actuating device can be connected to switch 100 and operated to displace actuator 130 in the electronic firing mode. First switch 100 is operable by trigger 90 to operate actuator 130 when the electronic firing system 68 is turned on or operationally enabled by a mode selector switch (not shown) that is movable between an on position and an off position. The mode selector switch can be operable by selector mechanism 200 to allow the user or shooter to select the on/enable and off/disable positions for the electronic firing system 68.

Grip assembly 40 may further include a grip safety 140 (FIG. 2) that is pivotally mounted to a rearward side of grip assembly 40. Grip safety 140 engages a third switch 142 of printed circuit board 122 to provide a further enablement feature for the electronic firing mode of selective fire firearm 30 with trigger 90 and electronic actuator 110 when grip safety 140 is depressed by the shooter and when mode selector switch is on. The switches are connected to printed circuit board 122 to allow the user or shooter to selectively control the electronic firing system 68 of selective fire firearm 30.

In certain embodiments, the actuator 130 includes solenoid 131 to displace a rod-shaped sear displacement member 114 of the actuator 130 that is linearly movable in response to activation of the solenoid 131. Sear displacement member 114 includes an end member 116 for contact by solenoid 131 and an elongated shaft 118 extending from end member 116 through a longitudinal bore of a fastening member 150. Sear displacement member 114 extends through fastening member 150 to a second end 117 that engages, either directly or indirectly, a rearward end portion of the sear assembly 70. As sear displacement member 114 moves upwardly and longitudinally through fastener 150, it pushes on sear assembly 70 to release engagement of the sear assembly with the hammer 91 from the cocked position to electronically fire the selective fire firearm 30.

Fastening member 150 includes an elongated body 160 extending between a first end 162 and an opposite second end 164. Adjacent first end 162 fastening member 150 includes a nut 166, and a threaded shaft 168 extends from first end 162 to second end 164. Shaft 168 may include a non-threaded portion 167, and nut 166 can be displaced along the threaded shaft portion that is adjacent first end 162. Fastening member 150 may also or alternatively include a head or other fixed structure at first end 162.

Body 160 further defines a longitudinal bore 170 that extends between and opens at first end 162 and second end 164. Body 160 also includes a longitudinal slot 176 paralleling bore 170 that receives the trigger lever 98 therein to guide the longitudinal movement of trigger lever 98. Engagement end portion 108 projects outwardly from slot 176 to contact switch actuator 102. The slot 176 can be separated from bore 170 by a wall of shaft 168, or can open into bore 170. First end 162 and/or nut 166 can be configured to engage a driving tool to drive fastening member 150 through grip assembly 40 and into a threaded bore in lower receiver 38 to secure grip assembly 40 to lower receiver 38.

In the illustrated embodiment, although fastening member 150 is shown with a threaded shaft 168, a threaded engagement between fastening member 150 and lower receiver 38 is not required. Any suitable fastening arrangement is contemplated. In still other embodiments, sear displacement member 114 does not extend through a fastening member that fastens grip assembly 40 to lower receiver 38, and any suitable fastening member secured to at least one part or portion of the firearm to another which defines a travel path for sear displacement member 114 and/or trigger lever 98 is contemplated.

Electronic firing assembly 68 can be utilized in conjunction with existing semi-automatic and automatic weaponry designs to improve firearm operations and facilitate selection of the firing mode or safety of the firearm. In addition, the electronically controlled firing mechanism is beneficial in reducing uncertainties associated with trigger pull in mechanical systems, which is commonly known to effect shooting accuracy. Furthermore, the electronic firing assembly 68 includes a means for the shooter to select various manners in which firearm 30 will function when in the electronic firing mode.

Various aspects of the present disclosure are contemplated. According to one aspect, a firearm includes a lower receiver and a trigger pivotal relative to the lower receiver. The lower receiver includes a hammer moveable from a cocked position toward an uncocked position to fire the firearm. The lower receiver further includes a sear assembly positionable to secure the hammer in the cocked position, and the hammer is releasably engageable to the sear assembly. The firearm also includes a grip assembly attached to the lower receiver with a fastening member. The firearm also includes an electronic firing system including an electronic actuator with a switch for electronically firing the firearm and a trigger lever connected to the trigger. The trigger lever is reciprocally moveable along the fastening member in response to a pull of the trigger to displace the trigger lever and actuate the switch to fire the firearm.

In one embodiment, the electronic firing system includes a sear displacement member that is reciprocally moveable in a bore through the fastening member in response to a pull of the trigger to displace the sear assembly thereby releasing the sear assembly from the hammer when in the cocked position to fire the firearm. In one refinement of this embodiment, the fastening member includes a slot along the bore and the trigger lever extends along the fastening member in the slot. In another refinement, the fastening member includes a threaded shaft threadingly engaged to the lower receiver and the bore extends through the threaded shaft. In a further refinement, the sear displacement member includes an elongated shaft extending through the fastening member, and the shaft extends between a first end and a second end that projects from the fastening member toward the sear assembly. In still another refinement, the fastening member includes a threaded shaft and a nut adjacent a first end of the threaded shaft.

In another embodiment, the trigger is pivotally coupled with the sear assembly. In a refinement of this embodiment, the trigger includes a trigger arm extending rearwardly from the pivotal coupling of the trigger with the sear assembly, and the trigger lever is connected with a rearward end of the trigger arm. In another refinement, the trigger lever includes an engagement arm that is engaged in a receptacle of the trigger arm. In yet another refinement, the trigger lever includes an L-shaped engagement member that rides along a switch actuator associated with the switch to actuate the switch in response to a pull of the trigger.

In another aspect, an electronic firing system for a firearm is provided that includes an electronic actuator with a switch for electronically firing the firearm and a trigger lever connectable to a trigger. The trigger lever is reciprocally moveable along a fastening member that is for attaching a grip assembly to a lower receiver of the firearm. The fastening member guides longitudinal movement of the trigger lever along the fastening member in response to a pull of the trigger as the trigger lever is displaced to actuate the switch to fire the firearm.

In one embodiment, the system includes a sear displacement member that is reciprocally moveable in a bore through the fastening member in response to the pull of the trigger to displace a sear assembly of the firearm that is operable to secure a hammer in a cocked position. In a refinement of this embodiment, the fastening member includes a slot along the bore and the trigger lever extends along the fastening member in the slot. In another refinement, the fastening member includes a threaded shaft and the bore extends through the threaded shaft. In yet a further refinement, the sear displacement member includes an elongated shaft extending through the fastening member, and the shaft extends between one end that is adjacent a first end of the fastening member and an opposite end that projects from a second end of the fastening member. In still a further refinement, the fastening member includes a nut adjacent the first end of the fastening member threadingly engaged to the fastening member.

According to another aspect, an electronic firing system for a firearm includes an electronic actuator with a switch for electronically firing the firearm and an elongated fastening member for securing a first portion of the firearm to a second portion of the firearm. The system also includes a trigger lever connectable to a trigger of the firearm. The fastening member guides longitudinal movement of the trigger lever along the fastening member in response to a pull of the trigger as the trigger lever is displaced to actuate the switch to fire the firearm.

In one embodiment, the fastening member includes a longitudinal bore, a longitudinal slot along the bore, and the trigger lever extends along the fastening member in the slot. In a refinement of this embodiment, the system includes a sear displacement member that includes an elongated shaft extending through the bore of the fastening member, and the shaft extends between one end that is adjacent a first end of the fastening member and an opposite end that projects from a second end of the fastening member. In a further refinement, the fastening member includes a threaded shaft with a non-threaded portion between first and second ends of the threaded shaft, and a nut engaged adjacent to the first and of the threaded shaft.

While the invention has been illustrated and described in detail in the drawings and foregoing description, the same is to be considered as illustrative and not restrictive in character, it being understood that only certain exemplary embodiments have been shown and described. Those skilled in the art will appreciate that many modifications are possible in the example embodiments without materially departing from this invention. Accordingly, all such modifications are intended to be included within the scope of this disclosure as defined in the following claims.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A firearm, comprising:

a lower receiver and a trigger pivotal relative to the lower receiver, the lower receiver including a hammer: moveable from a cocked position toward an uncocked position to fire the firearm, the lower receiver further including a sear assembly positionable to secure the hammer in the cocked position, wherein the hammer is releasably engageable to the sear assembly;

a grip assembly attached to the lower receiver with a fastening member; and an electronic firing system including an electronic actuator with a switch for electronically firing the firearm and a trigger lever connected to the trigger, wherein the trigger lever is reciprocally moveable along a travel path defined by the fastening member in response to a pull of the trigger to displace the trigger lever and actuate the switch to fire the firearm.

2. The firearm of claim 1, wherein the electronic firing system includes a sear displacement member that is reciprocally moveable in a bore through the fastening member in response to a pull of the trigger to displace the sear assembly thereby releasing the sear assembly from the hammer when in the cocked position to fire the firearm.

3. The firearm of claim 2, wherein the fastening member includes a slot along the bore and the trigger lever extends along the fastening member in the slot.

4. The firearm of claim 2, wherein the fastening member includes a threaded shaft threadingly engaged to the lower receiver and the bore extends through the threaded shaft.

5. The firearm of claim 4, wherein the sear displacement member includes an elongated shaft extending through the fastening member, the shaft extending between a first end and a second end that projects from the fastening member toward the sear assembly.

6. The firearm of claim 5, wherein the fastening member includes a threaded shaft and, a nut adjacent a first end of the threaded shaft.

7. The firearm of claim 1, wherein the trigger is pivotally coupled with the sear assembly.

8. The firearm of claim 7, wherein the trigger includes a trigger arm extending rearwardly from the pivotal coupling of the trigger with the sear assembly, and the trigger lever is connected with a rearward end of the trigger arm.

9. The firearm of claim 8, wherein the trigger lever includes an engagement arm that is engaged in a receptacle of the trigger arm.

10. The firearm of claim 8, wherein the trigger lever includes an L shaped engagement member at one end thereof that rides along a switch actuator associated with the switch to actuate the switch in response to a pull of the trigger.

11. An electronic firing system for a firearm, comprising:

an electronic actuator with a switch for electronically firing the firearm and a trigger lever connectable to a trigger, wherein the trigger lever is reciprocally moveable along a fastening member, the fastening member for attaching a grip assembly to a lower receiver of the firearm, wherein the fastening member guides longitudinal movement of the trigger lever along the fastening member in response to a pull of the trigger as the trigger lever is displaced to actuate the switch to fire the firearm.

12. The electronic firing system of claim 11, further comprising a sear displacement member that is reciprocally moveable in a bore through the fastening member in response to the pull of the trigger to displace a sear assembly of the firearm that is operable to secure a hammer in a cocked position.

13. The electronic firing system of claim 12, wherein the fastening member includes a slot along the bore and the trigger lever extends along the fastening member in the slot.

14. The electronic firing system of claim 12, wherein the fastening, member includes a threaded shaft and the bore extends through the threaded shaft.

15. The electronic firing system of claim 14, wherein the sear displacement member includes an elongated shaft extending through the fastening member, the shaft extending between one end that is adjacent a first end of the fastening member and an opposite end that projects from a second end of the fastening member.

16. The electronic firing system of claim 15, wherein the fastening member includes a nut threadingly engaged adjacent the first end of the fastening member.

17. An electronic firing system for a firearm, comprising:

an electronic actuator with a switch for electronically firing the firearm;

an elongated fastening member for securing a first portion of the firearm to a second portion of the firearm; and a trigger lever connectable to a trigger of the firearm, wherein the fastening member guides longitudinal movement of the trigger lever along the fastening member in response to a pull of the trigger as the trigger lever is displaced to actuate the switch to fire the firearm.

18. The electronic firing system of claim 17, wherein the fastening member includes a longitudinal bore, a longitudinal slot along the bore, and the trigger lever extends along the fastening member in the slot.

19. The electronic firing system of claim 18, further comprising a sear displacement member that includes an elongated shaft extending through the bore of the fastening member, the shaft extending between one end that is adjacent a first end of the fastening member and an opposite end that projects from a second end of the fastening member.

20. The electronic firing system of claim 19, wherein the fastening member includes a threaded shaft with a non-threaded portion between first and second ends of the threaded shaft, and a nut engaged adjacent to the first end of the threaded shaft.

* * * * *